US008913752B2

(12) United States Patent
Tong et al.

(10) Patent No.: US 8,913,752 B2
(45) Date of Patent: Dec. 16, 2014

(54) AUDIO SIGNAL MEASUREMENT METHOD FOR SPEAKER AND ELECTRONIC APPARATUS HAVING THE SPEAKER

(75) Inventors: Hann-Shi Tong, Taoyuan County (TW); Yu-Sheng Lee, Taoyuan County (TW); Yu-Chieh Lai, Taoyuan County (TW); Lei Chen, Taoyuan County (TW); Chun-Ren Hu, Taoyuan County (TW); Wei-Syuan Lin, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 295 days.

(21) Appl. No.: 13/426,610

(22) Filed: Mar. 22, 2012

(65) Prior Publication Data

US 2013/0251158 A1 Sep. 26, 2013

(51) Int. Cl.
*H04R 29/00* (2006.01)

(52) U.S. Cl.
USPC ..... 381/56; 381/55; 381/83; 381/98; 381/103

(58) Field of Classification Search
CPC .... H04R 1/227; H04R 1/2803; H04R 1/2873; H04R 3/002; H04R 3/007; H04R 3/02; H04R 3/04; H04R 3/06; H04R 3/08; H04R 29/001; H04R 29/002; H04R 29/003; H04R 29/007; H04R 29/008; H04R 2201/028; H04R 2430/01; H04R 2430/20; H04R 3/00; H04R 1/1083; H04R 2499/11; G01R 1/30; G01R 1/36; G01R 1/40; G01R 1/42; G01R 1/44; G10K 2210/108; G10K 2210/3023; G10K 2210/3028; G10K 2210/3035; G10K 2210/511; G10L 19/02; G10L 21/0316; G10L 25/51; H03G 3/3005; H04S 3/002
USPC ..... 381/58, 59, 55, 305, 306, 308, 83, 84, 381/85, 332, 93, 97, 98, 103, 56; 700/94
See application file for complete search history.

(56) References Cited

U.S. PATENT DOCUMENTS

| | | | | |
|---|---|---|---|---|
| 5,068,903 | A * | 11/1991 | Walker | 381/96 |
| 8,023,668 | B2 * | 9/2011 | Pfaffinger | 381/164 |
| 2005/0031132 | A1 * | 2/2005 | Browning et al. | 381/59 |
| 2009/0028349 | A1 * | 1/2009 | Park | 381/59 |
| 2011/0194705 | A1 * | 8/2011 | Gautama | 381/59 |
| 2011/0228945 | A1 * | 9/2011 | Mihelich et al. | 381/59 |
| 2013/0077795 | A1 * | 3/2013 | Risbo et al. | 381/55 |

* cited by examiner

*Primary Examiner* — Leshui Zhang
(74) *Attorney, Agent, or Firm* — Jianq Chyun IP Office

(57) ABSTRACT

An audio signal measurement method for a speaker and an electronic apparatus having the speaker are provided. The electronic apparatus further has a processing circuit and a power amplifier. The processing circuit is coupled to the speaker and configured to execute a time domain to frequency domain transform according to a voltage value of an audio signal and a current value of current feedback from the speaker so as to obtain a frequency response curve. The power amplifier is coupled to the speaker and configured to drive the speaker according the voltage value of the audio signal. The processing circuit is capable of determining whether the frequency response curve is located within a predetermined area such that the processing circuit generates a signal when the frequency response curve is located out of the predetermined area. Thereby, the electronic apparatus may measure its transducer distortion and acoustic box leakage.

14 Claims, 4 Drawing Sheets

AUDIO SIGNAL MEASUREMENT METHOD FOR SPEAKER AND ELECTRONIC APPARATUS HAVING THE SPEAKER

BACKGROUND

1. Technical Field

The disclosure is directed to an audio signal measurement method for a speaker, and an electronic apparatus having the speaker, and more particularly to an electronic apparatus capable of self-testing a speaker thereof and an audio signal measurement method for the speaker.

2. Description of Related Art

In current modern society with increasingly developed multi-media, the quality of speakers is often one of the keys leading to virtue or vice of sounds heard by users. A speaker having bad quality usually results in a certain level of transducer distortion and acoustic box leakage. Conventionally, a microphone is usually used to test transducer distortion and acoustic box leakage for the speaker. However, such measurement method typically requires enough spaces and cost for installing an anechoic room and an acoustic analyzer. Thus, for the users, the conventional audio signal measurement method for the speaker in the related art will be difficult to put into use due to an obstacle to budgets and spaces that is difficult to overcome.

SUMMARY

The disclosure is directed to an electronic apparatus capable of self-testing whether a speaker thereof is operated normally.

The disclosure is directed to an audio signal measurement method for a speaker, which is adopted to determining whether the speaker is operated normally.

The disclosure is directed to an audio signal measurement method for a speaker. The audio signal measurement method includes measuring a voltage value of an audio signal and measuring a current value of a current feedback from the speaker. The audio signal measurement method further includes executing a time domain to frequency domain transform according to the voltage value and the current value so as to obtain a frequency response curve. The audio signal measurement method yet further includes determining whether the frequency response curve falls within a predetermined area and sending out a signal if the frequency response curve falls out of the predetermined area.

The disclosure is directed to an electronic apparatus. The electronic apparatus includes a speaker, a processing circuit and a power amplifier. The speaker is configured to send out sounds. The processing circuit is coupled to the speaker and configured to execute a time domain to frequency domain transform according to a voltage value of an audio signal and a current value of a current feedback from the speaker so as to obtain a frequency response curve. The power amplifier is coupled to the speaker and configured to drive the speaker according the voltage value of the audio signal. Herein, the processing circuit is capable of determining whether the frequency response curve falls within a predetermined area and sending out a signal when the frequency response curve falls out of the predetermined area.

In one embodiment of the disclosure, the time domain to frequency domain transform is a Fourier transform.

In one embodiment of the disclosure, the Fourier transform is a fast Fourier transform (FFT).

In one embodiment of the disclosure, the time domain to frequency domain transform is a Laplace transform.

In one embodiment of the disclosure, the voltage value is represented by a time function v(t), the current value is presented by a time function i(t), and the frequency response curve is obtained by executing the time domain to frequency domain transform on [v(t)/i(t)], where t represents time.

In one embodiment of the disclosure, the voltage value is represented by the time function v(t), the current value is presented by the time function i(t), and the frequency response curve is obtained by executing the time domain to frequency domain transform on $$\left(\int_0^t \frac{v(t) - i(t) \times R_{dc}}{B1}\, dt\right),$$

where t represents time, $R_{dc}$ is a resistor value of the driving device of the speaker under a normal room temperature, and B1 is a constant value of the speaker.

In one embodiment of the disclosure, the electronic apparatus further includes an augmenter, which is coupled to the processing circuit and configured to augment a source signal to generate the audio signal. When the frequency response curve falls out of the predetermined area, the processing circuit adjusts a gain for the audio signal.

In one embodiment of the disclosure, the frequency response curve is configured to present a relationship between an impedance of the speaker and a frequency of the sound sent from the speaker.

In one embodiment of the disclosure, the frequency response curve is configured to represent a relationship between a stroke of a diaphragm of the speaker and the frequency of the sound sent from the speaker.

To sum up, the electronic apparatus as described according to the embodiments of the disclosure may self-measure whether the speaker thereof meets desired requirements. Since neither an anechoic room nor an acoustic analyzer requires to be additionally installed, the usage convenience may be significantly enhanced, and the testing cost for the speaker may be lower down.

In order to make the aforementioned and other features and advantages of the disclosure more comprehensible, embodiments accompanying figures are described in detail below.

BRIEF DESCRIPTION OF THE DRAWINGS

The accompanying drawings constituting a part of this specification are incorporated herein to provide a further understanding of the disclosure. Here, the drawings illustrate embodiments of the disclosure and, together with the description, serve to explain the principles of the disclosure.

DESCRIPTION OF EMBODIMENTS

Figure 1:
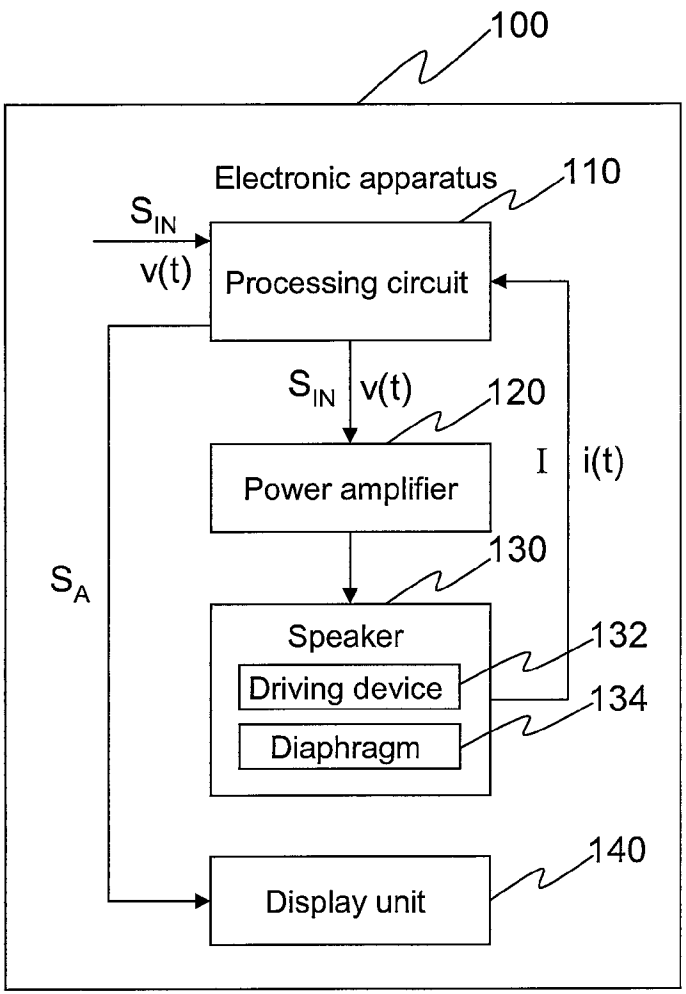
FIG. 1 is a functional block diagram of an electronic apparatus of one embodiment of the disclosure.

Referring to FIG. 1, FIG. 1 is a functional block diagram of an electronic apparatus of one embodiment of the disclosure. An electronic apparatus 100 may be a mobile phone, a tablet computer, a multi-media screen, a television and so on, but the disclosure is not limited thereto. The electronic apparatus 100 has a processing circuit 110, a power amplifier 120 and a speaker 130. The speaker 130 is configured to send out sounds based on an audio signal $S_{IN}$. The processing circuit 110 is coupled to the speaker 130 and measures a voltage value v(t) of the received audio signal $S_{IN}$. The processing circuit 110 transmits the received audio signal $S_{IN}$ to the power amplifier 120 such that the power amplifier 120 drives the speaker 130 to send out one sound according to the voltage value v(t) of the audio signal $S_{IN}$. Typically, the power amplifier 120 is connected with a system voltage of the electronic apparatus 100 to supply power to the speaker 130. The speaker 130 feeds back a current I to the processing circuit 110, and the processing circuit 110 measures the current value i(t) of the current I. In addition, The processing circuit 110 executes a time domain to frequency domain transform according to the voltage value v(t) of the audio signal $S_{IN}$ and the current value i(t) of the current I feedback from the speaker 130 so as to obtain a frequency response curve.

Figure 2:
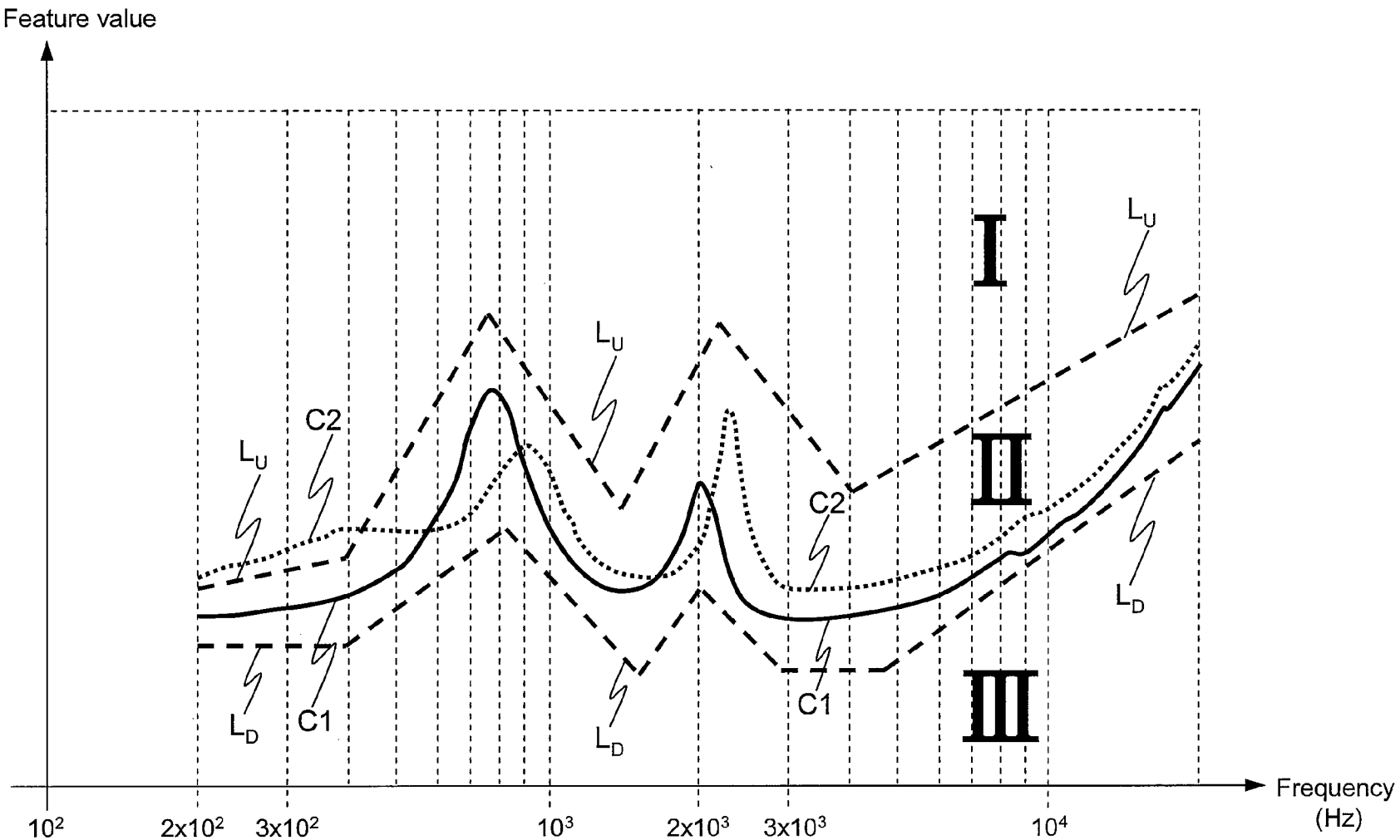
FIG. 2 is a diagram showing a frequency response curve of an electronic apparatus of one embodiment of the disclosure.

Referring to FIG. 2 with FIG. 1, FIG. 2 is a diagram showing a frequency response curve of an electronic apparatus of one embodiment of the disclosure. A frequency response curve C1 is one frequency response curve obtained by the processing circuit 110 executing the time domain to frequency domain transform according to the voltage value v(t) and the current value i(t). The horizontal axis in FIG. 2 represents each frequency of each sound sent out from the speaker 130, and the vertical axis represents each feature value corresponding to the speaker 130 based on each frequency. Herein, after voltage value v(t) and the current value i(t) are transformed to the frequency domain, the frequency of the processing circuit 110 corresponds to the frequency of the sound sent from the speaker 130, and thus, the horizontal axis in FIG. 2 may also represent the frequency corresponding to the voltage value v(t) or the current value i(t) transformed to the frequency domain. In one embodiment of the disclosure, the feature value as described above is an impedance of the speaker 130 measured by the processing circuit 110 and namely, the frequency response curve C1 is configured to present a relationship between the impedance of the speaker 130 and the frequency of the sound sent from the speaker 130. In another embodiment of the disclosure, the feature value as described above is a stroke of an diaphragm 134 of the speaker 130 measured by the processing circuit 110 and namely, the frequency response curve C1 is configured to present a relationship between the stroke of the diaphragm 134 of the speaker 130 and the frequency of the sound sent from the speaker 130. The processing circuit 110 determines whether the frequency response curve C1 falls within a predetermined area II. When the processing circuit 110 has determined that the frequency response curve falls within an area I or an area III rather than within the predetermined area II, the processing circuit 110 sends a signal $S_A$ to remind a user of the electronic apparatus 100. For example, a portion of a frequency response curve C2 falls out of the predetermined area II, and accordingly, if the frequency response curve obtained by the processing circuit 110 is the frequency response curve C2, the processing circuit 110 sends out the signal $S_A$. The aforementioned areas I, II and III are defined by an upper-limit curve $L_U$ and a lower-limit curve $L_D$, and each feature value corresponding to the upper-limit curve $L_U$ and the lower-limit curve $L_D$ based on each frequency may be configured according to different user demands.

In another embodiment of the disclosure, the electronic apparatus 100 may also includes a display unit 140, which is configured to display a message in connection with the signal $S_A$ to remind the user. The display unit 140 may be a touch screen or a non-touch screen.

In one embodiment of the present disclosure, the speaker 130 has a driving device 132 and the diaphragm 134. The driving device 132 is configured to drive the diaphragm 134 to vibrate according to a signal outputted by the power amplifier 120 so as to generate an acoustical wave. In one embodiment of the disclosure, the driving device 132 is a coil, which is configured to drive the diaphragm 134 to vibrate in an electromagnetic induction manner. In addition, in one embodiment of the disclosure, the driving device 132 and the diaphragm 134 are respectively disposed on two substrates, and the driving device 132 is a thin film electrode formed by metal, and the diaphragm 134 may carry statistic electricity. The aforementioned two substrates may be made of fiber. In other words, the two substrates may be two pieces of paper.

In one embodiment of the disclosure, the time domain to frequency domain transform executed by the processing circuit 110 is a Fourier transform, and the Fourier transform includes a fast Fourier transform (FFT). In one embodiment of the disclosure, the time domain to frequency domain transform executed by the processing circuit 110 is a Laplace transform.

In addition, in one embodiment of the disclosure, the voltage value of the audio signal $S_{IN}$ is represented by a time function v(t), the current value of the current I is presented by a time function i(t), where t represents time, and the processing circuit 110 executes the time domain to frequency domain transform on [v(t)/i(t)] to obtain one frequency response curve. The processing circuit 110 executes the time domain to frequency domain transform on [v(t)/i(t)] to obtain the frequency response curve, and the feature value corresponding thereto is the impedance of the speaker 130. In one embodiment of the disclosure, the processing circuit 110 executes the time domain to frequency domain transform on $$\left(\int_0^t \frac{v(t) - i(t) \times R_{dc}}{B1}\, dt\right)$$

to obtain one frequency response curve, where $R_{dc}$ is a resistor value of the driving device 132 of the speaker 130 under a room temperature (about 25° C.), and a constant value B1 varies with of different speakers 130. The processing circuit 110 executes the time domain to frequency domain transform on $$\left(\int_0^t \frac{v(t) - i(t) \times R_{dc}}{B1}\, dt\right)$$

to obtain the frequency response curve, and the feature value corresponding thereto is the stroke of the diaphragm 134.

Figure 3:
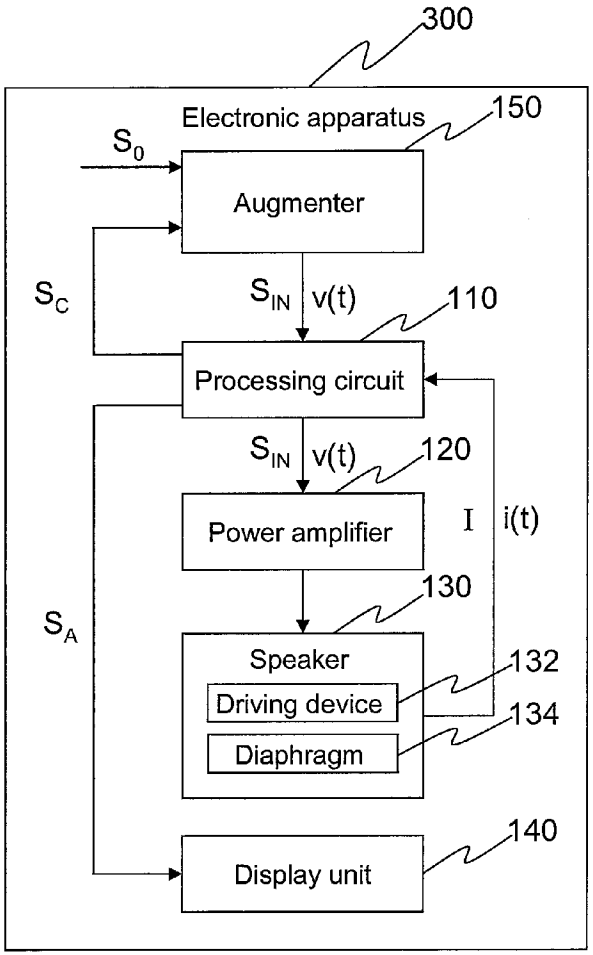
FIG. 3 is a functional block diagram of an electronic apparatus of another embodiment of the disclosure.

In one embodiment of the disclosure, the electronic apparatus may further include an augmenter, which is configured to augment a source signal to generate the audio signal $S_{IN}$. Referring to FIG. 3, FIG. 3 is a functional block diagram of an electronic apparatus 300 of another embodiment of the disclosure. The major difference between the electronic apparatus 300 and the electronic apparatus 100 relies on the electronic apparatus 300 having an augmenter 150. As for other devices of the electronic apparatus 300, they are the same as those in the electronic apparatus 100, and will not be described repeatedly hereinafter. The augmenter 150 is coupled to the processing circuit 150 and configured to gain a source signal $S_0$ to generate the audio signal $S_{IN}$. When the frequency response curve obtained by the processing circuit 110 according to the voltage value v(t) and the current value i(t) falls out of the predetermined area, the processing circuit 110 adjusts the gain of the augmenter 150 so that the adjusted frequency response curve may fall within the predetermined area. Usually, the processing circuit 110 lowers down the gain of the augmenter 150 so that the adjusted frequency response curve may fall within the predetermined area.

Figure 4:
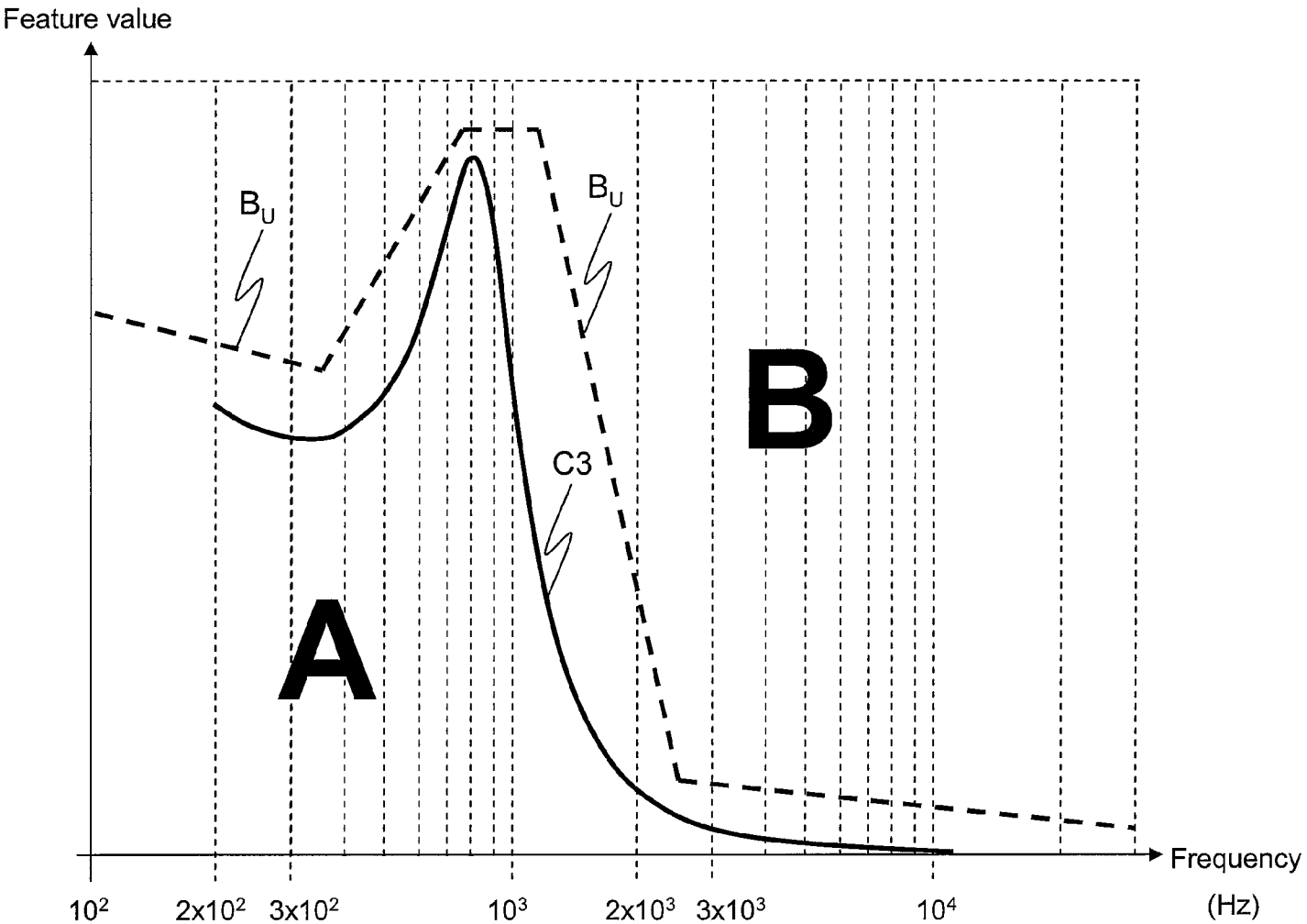
FIG. 4 is a diagram showing a frequency response curve of an electronic apparatus of another embodiment of the disclosure.

Referring to FIG. 4 with FIG. 3, FIG. 4 is a diagram showing a frequency response curve of an electronic apparatus of another embodiment of the disclosure. Therein, a frequency response curve C3 is one frequency response curve obtained by the processing circuit 110 executing the time domain to frequency domain transform according to the voltage value v(t) and the current value i(t). The horizontal axis in FIG. 4 represents each frequency of each sound sent out from the speaker 130, and the vertical axis represents each feature value corresponding to the speaker 130 based on each frequency. In one embodiment of the disclosure, the feature value as described above is the stroke of the diaphragm 134 of the speaker 130 measured by the processing circuit 110 and namely, the frequency response curve C3 is configured to present a relationship between the stroke of the diaphragm 134 of the speaker 130 and the frequency of the sound sent from the speaker 130.

The processing circuit 110 determines whether the frequency response curve C3 falls within a predetermined area A. When the processing circuit 110 has determined that the frequency response curve falls within an area B rather than within the predetermined area A, the processing circuit 110 sends the signal $S_A$ to remind the user of the electronic apparatus 100. The aforementioned areas A and B are defined by an upper-limit curve $B_U$, and a feature value corresponding to the upper-limit curve $B_U$ based on each frequency may be configured according to different user demands.

In light of the foregoing, the disclosure is directed to an electronic apparatus capable of self-testing whether a speaker thereof is operated normally. Since neither an anechoic room nor an acoustic analyzer requires to be additionally installed, the usage convenience may be significantly enhanced, and the testing cost for the speaker may be lower down.

Although the disclosure has been described with reference to the above embodiments, it will be apparent to one of the ordinary skill in the art that modifications to the described embodiment may be made without departing from the spirit of the disclosure. Accordingly, the scope of the disclosure will be defined by the attached claims not by the above detailed descriptions.

What is claimed is:

1. An audio signal measurement method for a speaker, wherein an electronic apparatus comprises the speaker and a processing circuit, the audio signal measurement method comprising:

measuring a voltage value of an audio signal, wherein the speaker sends out sounds based on the voltage value of the audio signal via the processing circuit;

measuring a current value of a current feedback from the speaker via the processing circuit;

executing a time domain to frequency domain transform according to the voltage value and the current value so as to obtain a frequency response curve via the processing circuit; and determining whether the frequency response curve falls within a predetermined area, and sending out a signal if the frequency response curve falls out of the predetermined area via the processing circuit and wherein the voltage value is represented by the time function v(t), the current value is presented by the time function i(t), and the frequency response curve is obtained by executing the time to frequency domain transform on $$\left(\int_0^t \frac{v(t) - i(t) \times R_{dc}}{B1}\, dt\right),$$

wherein t represents time, $R_{dc}$ is a resistor value of a driving device of the speaker under a normal room temperature, and B1 is a constant value of the speaker.

2. The audio signal measurement method as claimed in claim 1, wherein the time domain to frequency domain transform is a Fourier transform.

3. The audio signal measurement method as claimed in claim 2, wherein the Fourier transform is a fast Fourier transform (FFT).

4. The audio signal measurement method as claimed in claim 1, wherein the time domain to frequency domain transform is a Laplace transform.

5. The audio signal measurement method as claimed in claim 1, further comprising:

adjusting a gain for the audio signal if the frequency response curve falls out of the predetermined area via an augmenter coupled to the processing circuit.

6. The audio signal measurement method as claimed in claim 1, wherein the frequency response curve is configured to present a relationship between an impedance of the speaker and a frequency of a sound sent from the speaker.

7. The audio signal measurement method as claimed in claim 1, wherein the frequency response curve is configured to represent a relationship between a stroke of a diaphragm of the speaker and a frequency of a sound sent from the speaker.

8. An electronic apparatus, comprising:

a speaker;

a processing circuit, coupled to the speaker and configured to execute a time domain to frequency domain transform according to a voltage value of an audio signal and a current value of a current feedback from the speaker so as to obtain a frequency response curve; and a power amplifier, coupled to the speaker and configured to drive the speaker according to the voltage value of the audio signal, wherein the processing circuit is configured to determine whether the frequency response curve falls within a predetermined area and sending out a signal when the frequency response curve falls out of the predetermined area and wherein the voltage value is represented by the time function v(t), the current value is presented by the time function i(t), and the frequency response curve is obtained by executing the time domain to frequency domain transform on $$\left(\int_0^t \frac{v(t) - i(t) \times R_{dc}}{B1}\, dt\right),$$

wherein t represents time, $R_{dc}$ is a resistor value of an driving device of the speaker under a normal room temperature, and B1 is a constant value of the speaker.

9. The electronic apparatus as claimed in claim 8, wherein the time domain to frequency domain transform is a Fourier transform.

10. The electronic apparatus as claimed in claim 9, wherein the Fourier transform is a fast Fourier transform (FFT).

11. The electronic apparatus as claimed in claim 8, wherein the time domain to frequency domain transform is a Laplace transform.

12. The electronic apparatus as claimed in claim 8, further comprising: an augmenter, coupled to the processing circuit and configured to augment a source signal to generate the audio signal, wherein when the frequency response curve falls out of the predetermined area, the processing circuit adjusts a gain for the audio signal.

13. The electronic apparatus as claimed in claim 8, wherein the frequency response curve is configured to present a relationship between an impedance of the speaker and a frequency of a sound sent from the speaker.

14. The electronic apparatus as claimed in claim 8, wherein the frequency response curve is configured to represent a relationship between a stroke of a diaphragm of the speaker and a frequency of a sound sent from the speaker.

* * * * *